2/26/80 XR 4,190,828

United States Patent [19]

Wolf

[11] 4,190,828

[45] Feb. 26, 1980

[54] MOVEMENT SENSITIVE ANTI-THEFT ALARM

[76] Inventor: Daniel H. Wolf, 370 River Rd., Bogota, N.J. 07603

[21] Appl. No.: 916,472

[22] Filed: Jun. 19, 1978

[51] Int. Cl.[2] ..... G08B 13/14

[52] U.S. Cl. ..... 340/571; 200/61.45 R; 340/566

[58] Field of Search ..... 340/571, 566, 65; 200/61.45 R

[56] References Cited

U.S. PATENT DOCUMENTS

| | | | |
|---|---|---|---|
| 2,448,597 | 9/1948 | Jolley et al. | 340/65 |
| 2,758,296 | 8/1956 | Larsen . | |
| 2,797,405 | 6/1957 | Stelter . | |
| 3,044,053 | 7/1962 | Larsen . | |
| 3,375,376 | 3/1968 | Kermode | 340/566 |
| 3,644,921 | 2/1972 | Duggan et al. . | |
| 3,656,144 | 4/1972 | Forte . | |
| 3,701,140 | 10/1972 | Dixon . | |
| 3,815,118 | 6/1974 | McDonald . | |
| 3,828,310 | 8/1974 | Miller . | |
| 3,893,096 | 7/1975 | Tucci et al. . | |
| 4,023,157 | 5/1977 | Miller . | |
| 4,122,437 | 10/1978 | Peterson | 340/566 |

*Primary Examiner*—Glen R. Swann, III

*Attorney, Agent, or Firm*—James & Franklin

[57] ABSTRACT

The trigger mechanism is an electronic switch comprised of an LED and a photosensitive transistor. The active surfaces of the LED and photosensitive transistor are normally aligned, the LED being suspended by a wire from a support above the transistor. Vibration or movement above a given magnitude results in misalignment of the active surfaces which causes the transistor to generate a trigger signal. The sensitivity of the electronic switch is adjustable by varying the spacing between the active surfaces. A delay circuit is interposed between the electronic switch and the remainder of the alarm circuitry such that generation of the alarm signal is prevented for a preset time interval after the arming of the device in order to permit the electronic switch to achieve mechanical equilibrium.

12 Claims, 3 Drawing Figures

MOVEMENT SENSITIVE ANTI-THEFT ALARM

BACKGROUND OF THE INVENTION

The present invention relates to anti-theft alarms and, more particularly, to an alarm designed to prevent the theft of articles of unattended personal property such as handbags, attache cases, suit cases, or the like.

Articles of personal property, such as handbags and attache cases, are often left temporarily unattended at a location in a business establishment while the proprietor thereof is attending to duties at a location remote from the site of the article of personal property. For instance, secretaries often leave their handbags unattended at their desks while retrieving files or taking dictation at other locations within the business establishment. This situation presents an opportunity for other employees or persons who have gained entry to the business establishment either through authorized or unauthorized means to secure possession of the handbag and leave the premises or conceal the stolen item before the theft is discovered.

There have been a number of attempts to design alarms to prevent the theft of articles of personal property in instances such as described above. However, these alarms suffer from the common disadvantages of being bulky, heavy, complex, expensive and relatively insensitive, which are inherent in the use of the various types of mechanical trigger devices which are employed therein. Some alarms utilize mechanical trigger devices connected to the handle of the article of personal property such that the grasping of the handle actuates the alarm. However, if the article of personal property is lifted without using the handle, such an alarm is ineffective. Other mechanical trigger mechanisms are connected to the handbag clasp and thus are not actuated unless the handbag is opened. Still other trigger means are connected to the carrying strap and thus are not actuated unless the bag is pulled from the owner while the owner is holding the strap.

Another type of trigger mechanism incorporates a switch with a depressible elongated actuator which normally protrudes from the bottom of the handbag and is held in a depressed position by the weight thereof. When the handbag is lifted from the surface upon which it rests, the elongated actuator, which is springloaded, becomes extended, thereby actuating the alarm. This design is disadvantageous because it requires an aperture on the bottom of the handbag through which the elongated actuator can extend. Mechanical triggers have been used which are sensitive to tilting, such as through the use of a rolling ball which will move relative to the remainder of the mechanism when the article is moved. However, devices of this sort are generally rather insensitive and a thief, who is aware of the presence of the alarm, is usually able to manipulate the article of personal property in a manner which will not actuate the alarm as the article of personal property is being stolen.

In order to alleviate the above-mentioned disadvantages, it is possible to replace the mechanical trigger with a low-cost electrical actuator which is extremely sensitive to vibration. However, when this substitution is made, two problems result which must be overcome before a workable alarm is achieved. First, a vibration sensitive electronic switch will require a substantial amount of time after the article of personal property is placed in position and the alarm armed before it reaches mechanical equilibrium. Prior to this time, the mere placing of the article of personal property or the arming of same by turning a key or actuating a switch will set the alarm off due to the sensitivity of the device. Thus, it is necessary that the alarm remain insensitive to motion or vibration for a certain period after the arming thereof. Second, the sensitivity of the alarm must be adjustable so as to prevent the actuation of the alarm by ambient vibration below a given magnitude such as that caused by people walking by or vibrations caused by passing trains, machinery, etc. It is therefore required that the electronic actuator be extremely sensitive to any abnormal vibration or motion and yet be insensitive to ambient vibrations below a certain level.

It is further required that the alarm be compact, lightweight and inexpensive. The objects may be obtained through the utilization of commercially available, integrated circuits utilized in conjunction with an inexpensive electronic actuator, the sensitivity of which can be controlled in a simple manner such that same is insensitive to ambient vibrations below a given magnitude but is extremely sensitive to vibrations or movement above the preset magnitude.

It is, therefore, a prime object of the present invention to provide an alarm for preventing the theft of personal property wherein an electronic actuator is utilized which is sensitive to vibrations or movement.

It is another object of the present invention to provide an alarm for preventing theft of personal property wherein the sensitivity of the electronic actuator can be adjusted so as to render same insensitive to ambient vibrations below a given magnitude.

It is another object of the present invention to provide an alarm for preventing theft of personal property wherein the actuation of the alarm circuitry is prevented for predetermined time after arming of same in order to permit the electronic actuator to achieve mechanical equilibrium.

It is a further object of the present invention to provide an alarm for preventing the theft of personal property wherein an alarm signal is generated through the use of commercially available integrated circuits.

It is still another object of the present invention to provide an alarm for preventing theft of an article of personal property wherein the device is light-weight, small in size, simple and inexpensive to manufacture.

SUMMARY OF THE INVENTION

In accordance with the present invention, an alarm is provided for preventing theft of an article of personal property. The alarm includes movement sensitive trigger means and means operably connected to the trigger means which are effective, when actuated thereby, to generate an alarm signal. The trigger means includes electronic switch means and means for adjusting the sensitivity of the switch means to render same insensitive to ambient vibrations below a given magnitude.

The device also incorporates means for preventing the actuation of the alarm signal generating means for a given time interval after the alarm is armed. In this manner, the electronic switch means is permitted to reach mechanical equilibrium before the alarm signal can be generated, thereby preventing the placement of the article or the arming of the alarm circuit from setting off the alarm.

The electronic switch includes a photosensitive signal generating means and a light generating means. The photosensitive signal generating means is fixedly mounted to a support. Means are provided for suspending the light generating means from the support in opposing spaced relationship with the photosensitive means. Thus, light generated by the light generating means is sensed by the normally aligned photosensitive signal generating means, which generates an output signal of a given magnitude as long as the light is sensed thereby. However, if vibrations or movement cause the light generating means to move significantly from its position of alignment relative to the photosensitive signal generating means, a variation in the detected light will cause signal output of the photosensitive signal generating means to change magnitude. This change in magnitude is detected by a bistable circuit which changes its state, thereby actuating the alarm signal generating means to generate an audible alarm signal.

The sensitivity of the electronic switch can be adjusted to render same insensitive to ambient vibrations below a given magnitude. The sensitivity of the electronic switch is adjusted by varying the distance between the light generating means and the photosensitive signal generating means. This is achieved by effectively shortening the means which suspends the light generating means from the support. Since the light from the light generating means spreads out to a certain degree as it leaves the light generating means, same can be detected by the photosensitive signal generating means over a wider area as the distance between the photosensitive signal generating means and the light generating means increases. As the distance between the photosensitive signal generating means and the light generating means increases, more misalignment therebetween can be tolerated without actuating the alarm. Thus, the sensitivity of the trigger means can be adjusted simply by adjusting the distance between the light generating means and the photosensitive signal generating means.

Preferably, the light generated by the light generating means and the light received by the photosensitive signal generating means is collimated by utilizing short lengths of hollow tubing mounted over the active surface of each of the components. This permits more accurate adjustment of the sensitivity of the electronic switch by more accurately defining the area within which relative movement of the light generating means will not actuate the alarm.

BRIEF DESCRIPTION OF THE DRAWING

To these and other objects as may hereinafter appear, the present invention relates to an alarm for preventing theft of personal property, as described in the present specification and set forth in the annexed claims, taken together with the accompanying drawings, wherein like numerals refer to like parts and in which:

DESCRIPTION OF THE PREFERRED EMBODIMENT

Figure 1:
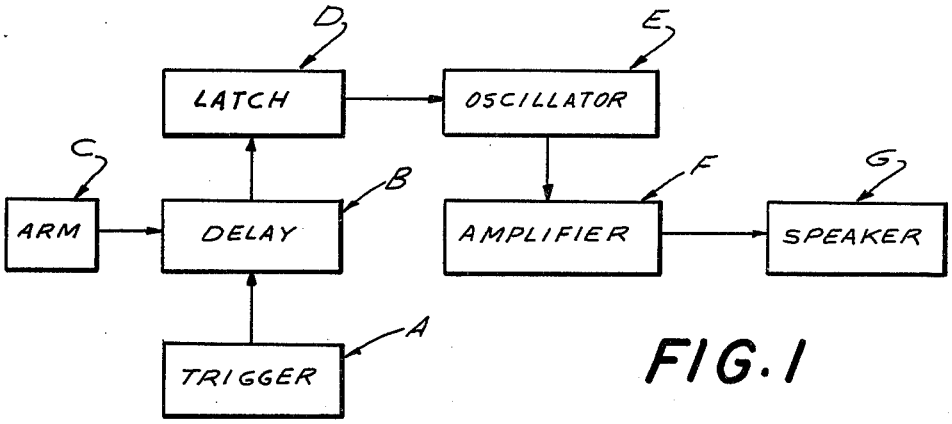
FIG. 1 is a block diagram of the alarm of the present invention.

As seen in FIG. 1, the alarm trigger means, generally designated A, is connected through a delay circuit, generally designated B, to a latch circuit, generally designated D. Delay circuit B is operably connected to an arming means, generally designated C, which initiates the time delay caused by the delay circuit B when the alarm is armed. During this time delay period, the output signal from trigger means A will not be transferred to latch circuit D such that vibrations caused by arming the alarm and/or by placement of the article of personal property in which the alarm is situated in the desired location will be prevented from changing the condition of latch circuit D.

However, after the delay period, the output signal from trigger means A will cause the latch circuit D, which comprises a bistable circuit, to change its condition. When the latch circuit D changes its condition, an actuation signal is generated thereby to an oscillator circuit, generally designated E. The oscillator circuit E, upon receipt of the actuation signal from latch circuit D, generates an oscillating signal at one or more frequencies. The oscillating signal from oscillation circuit E is fed to an amplification circuit, generally designated F, wherein it is amplified. The amplified oscillation signal is thereafter applied to a speaker, generally designated G, which generates an audible signal to indicate that the article of personal property has been moved. It should be appreciated that once the state of the bistable circuit within latch D has changed, the audible signal will continue to be generated until the arming circuit C is reset.

Delay circuit B, latch circuit D and oscillation circuit E are standard commercially available integrated circuits and therefore the operation thereof is not described in detail herein. For example, delay circuit B and latch circuit D may comprise the separate portions of an LM556 dual timer circuit, available from National Semiconductor Company and other semiconductor manufacturers. Oscillator circuit E may also comprise the same integrated circuit. While the abovementioned integrated circuit performs these functions adequately, it must be understood that other commercially available integrated circuit chips may be substituted therefor.

Figure 2:
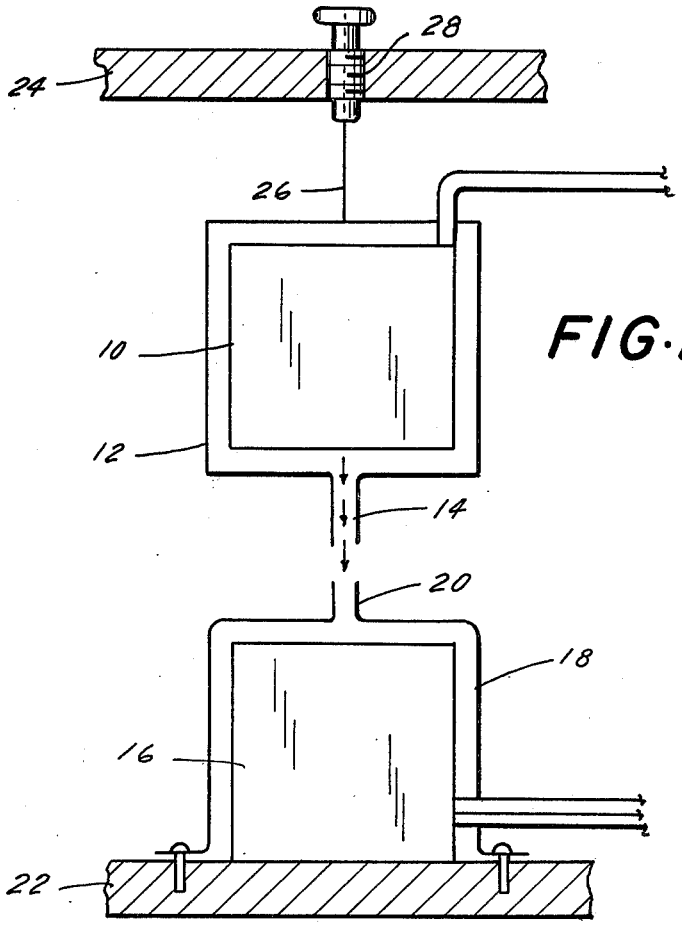
FIG. 2 is a diagrammatic representation of the electronic switch.

FIG. 2 is a diagrammatical representation of trigger means A. Trigger means A comprises a light generating means 10 which is preferably a light emitting diode of the infrared type of conventional design or any other commercially available light source, such as a small incandescent bulb or a gas discharge tube. Light generating means 10 is situated within a casing 12 having a hollow tubular protrusion 14 aligned with the light emitting surface thereof. Tube 14 serves to collimate the light generated by the light generating means 10, such that a relatively well defined column of light is emitted by the end of tube 14.

Situated in opposing spaced relationship with the light generating means 10 is a photosensitive signal generating means 16, which is contained within a casing 18 also having thereon a hollow protruding tube 20 aligned with the photosensitive surface thereof. Thus, when properly aligned, the light emitted from tube 14 enters tube 20 and impinges on the photosensitive surface of photosensitive signal generating means 16. Photosensitive signal generating means 16 may comprise any known light sensitive mechanism such as a photosensitive transistor or the like of known structure.

Casing 18, containing photosensitive signal generating means 16, is fixedly mounted to one surface 22 of a support, only a portion of which is illustrated in FIG. 2. Casing 12 containing light generating means 10 is connected to the opposing surface 24 of the support by means of a steel piano wire 26 or the like. The end of piano wire 26 is clamped or otherwise affixed to a screw 28, having external threads which engage a threaded aperture in surface 24 of the support.

It can now be appreciated that the relationship between the light generating means 10 and the photosensitive signal generating means 16 can be adjusted by simply rotating screw 28 such that the distance between the ends of tubes 14 and 20 is varied. The light emitted by light generating means 10, collimated to a great degree as it passes through tube 14, will spread out as it is emitted from the end of tube 14. The amount of spread of emitted light will be proportional to the distance between the ends of tubes 14 and 20. Therefore, as the distance between the ends of tubes 14 and 20 increases, so will the range of arcuate movement of the light generating means 10, with respect to the photosensitive signal generating means 16, within which adequate light is sensed by the photosensitive signal generating means 16 to prevent actuation of the alarm. In other words, the sensitivity of the alarm to vibration is determined by the spacing between the ends of tubes 14 and 20 and thus, by the rotational position of screw 28. Therefore, the adjustment of the sensitivity of the device is achieved by simply rotating screw 28.

It should be understood that the relative position of light generating means 10 with respect to photosensitive signal generating means 16 can be adjusted such that movement therebetween caused by ambient vibrations below a given magnitude can be prevented from actuating the alarm. Thus, trigger means A can be adjusted to be relatively insensitive to ambient vibrations below a given magnitude, such as would be caused by somebody walking by the alarm or machinery in the building, etc. On the other hand, if the alarm is moved in any manner, light generating means 10 will move in an arcuate path as it swings on wire 26. This will cause the ends of tubes 14 and 20 to become misaligned to a degree that a substantial portion of the light emitted from tube 14 no longer travels along tube 20 and is therefore no longer sensed by photosensitive signal generating means 16. When this occurs, photosensitive signal generating means 16 generates a signal which will cause the actuation of the alarm.

Figure 3:
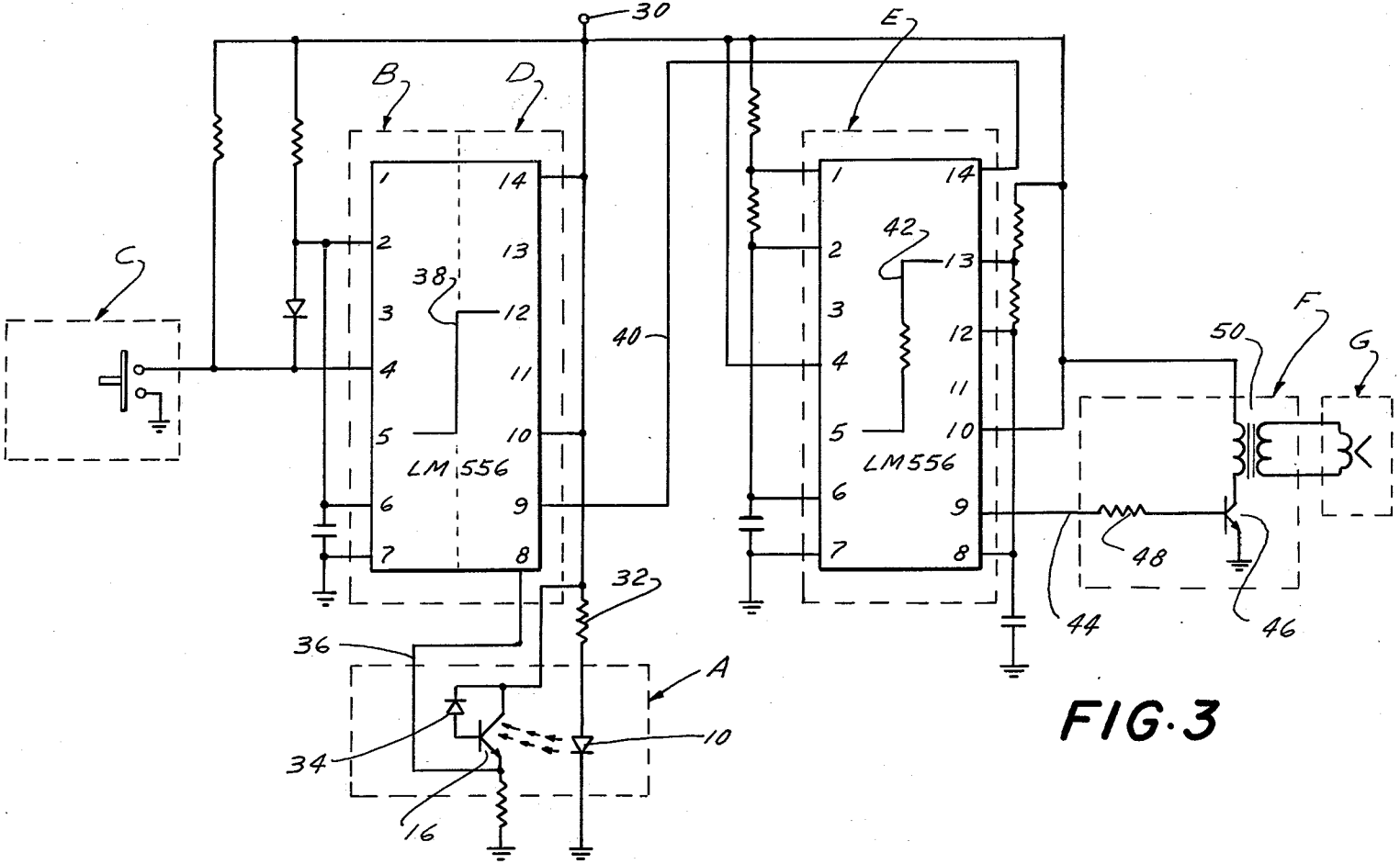
FIG. 3 is a schematic diagram of the alarm of the present invention.

As seen in FIG. 3, light emitting diode 10 is connected to a power source 30 through a resistor 32. Photosensitive transistor 16 is normally aligned with LED 10 and light emitted from LED 10 is received by photosensitive transistor 16 as indicated on the diagram by arrows. The collector of photosensitive transistor 16 is connected directly to power source 30, whereas the base thereof is connected to source 30 through a diode 34. The output of transistor 16 is connected, by means of lead 36, to the trigger input terminal of the second section of timer circuit 556, which forms latch circuit D. Latch circuit D cannot, however, be actuated to change state until the appropriate signal is also applied to threshold terminal 12 thereof. Terminal 12 is connected, by means of lead 38, to output terminal 5 of the first section of the circuit, which encompasses delay circuit B. Delay circuit B has as its reset terminal 4 connected to the output of arming circuit C, which may be a push-button switch or a key actuated switch, as desired. Delay circuit B acts as a timed power-up relay which conditions the latch circuit D to generate an output of low state whenever the unit is armed or reset by actuation arming circuit C. It should be understood that the duration of the time interval of delay circuit B can be set as desired. However, it has been found that a 22-second delay is more than adequate for the trigger means to reach the required mechanical equilibrium state.

Latch circuit D includes an RS flip-flop which is set to the high state when the output of photosensitive transistor 16 changes to indicate that light below a given magnitude level is sensed thereby. Thus, after the time delay resulting from the operation of delay circuit B, vibration or movement resulting in LED 10 becoming sufficiently misaligned with phototransistor 16 will cause phototransistor 16 to generate an output signal to latch circuit D causing the bistable circuit therein to change its state. The output terminal 9 of latch circuit D is connected to the input terminal 14 of oscillator circuit E by means of a lead 40.

Oscillator circuit E is also an LM-556 duel timer circuit having two sections. The first section acts as a 4 Hz astable multivibrator and the second section acts as a 1 KHz astable multivibrator whose frequency is changed eight times a second by the output of the first section. It should be noted that the two sections of oscillator circuit E are connected by means of a lead 42.

The output of oscillator circuit E appears on lead 44 which is connected as an input to amplifier circuit F. Amplifier circuit F consists of a transistor 46 whose base is connected to lead 44 by means of a resistor 48 and whose collector is connected to the primary side of an impedance matching transformer 50. The purpose of amplifier circuit F is to amplify the output of the oscillator circuit E. The secondary windings of transformer 50 are connected as an input to speaker G which is of standard design.

It should now be appreciated that the present invention relates to a small, light-weight, inexpensive, highly sensitive alarm designed for the prevention of theft of articles of personal property such as handbags, attache cases, etc. The alarm incorporates a trigger mechanism including an electronic switch, the sensitivity of which can be adjusted to render same insensitive to ambient vibrations below a given magnitude. The switch comprises a light source and a photosensitive transistor, one of which is suspended from a support by a wire. The alarm is triggered when vibration or movement of the device causes substantial misalignment between the light source and the photosensitive transistor. The sensitivity of the electronic switch is readily adjustable by varying the spacing between the light source and the photosensitive transistor.

A delay circuit is utilized to prevent triggering of the alarm by vibrations caused by arming the alarm and/or the placement of the device, until the electronic switch has attained mechanical equilibrium. The alarm circuitry consists of commercially available integrated circuit components which are inexpensive to purchase and assemble.

While only a single embodiment of the present invention has been described herein for purposes of illustration, it is obvious that many modifications and variations could be made thereto. It is intended to cover all of these modifications and variations which fall within the scope of the present invention, as defined by the following claims:

I claim:

1. An alarm for preventing theft of a movable article comprising movement sensitive trigger means and means operably connected to said trigger means effective, when actuated thereby, to generate an alarm signal, said trigger means comprising a support, photosensitive signal generating means mounted on said support, light generating means and means for suspending said light generating means from said support in opposing spaced relationship with said photosensitive means, said light generating means and photosensitive means being normally substantially aligned, said photosensitive signal generating means actuating said alarm signal generating means upon substantial misalignment between said light generating means and said photosensitive signal generating means.

2. The alarm of claim 1, wherein said trigger means further comprises bistable means operably connected to said photosensitive signal generating means effective, when actuated by said photosensitive signal generating means, to generate an actuation signal.

3. The alarm of claim 2, wherein said trigger means further comprises arming means and delay means, said arming means being operably connected to said delay means to actuate same, said delay means being operably interposed between said photosensitive generating means and said bistable means and effective, when actuated, to prevent the generation of said actuation signal for a preselected time interval after actuation of same.

4. The alarm of claim 1, wherein said alarm signal generating means comprises oscillation means effective, when actuated by said trigger means, to generate an oscillation signal, and amplifier means operably connected to receive said oscillation signal and amplify same.

5. The alarm of claim 4, wherein said alarm signal generating means further comprises means for converting said amplified oscillation signal into an audible signal.

6. The alarm of claim 1, further comprising means for collimating the light generated by said light generating means.

7. The alarm of claim 1, further comprising means for collimating the light received by said photosensitive signal generating means.

8. An alarm for preventing theft of a movable article comprising movement sensitive trigger means and means operably connected to said trigger means effective, when actuated thereby, to generate an alarm signal, said movement sensitive trigger means comprising electronic switch means and means for adjusting the sensitivity of said switch means to vibration and movement, said switch means comprising photosensitive signal generating means and light generating means, and further comprising a support and means for suspending one of said photosensitive signal generating means and said light generating means from said support, such that same is in opposing spaced relationship with the other of said photosensitive generating means and said light generating means.

9. The alarm of claim 8, further comprising means for collimating the light generated by said light generating means.

10. The alarm of claim 8, further comprising means for collimating the light received by said photosensitive signal generating means.

11. The alarm of claim 8, wherein said sensitivity adjusting means comprises means for adjusting the spacing between said photosensitive signal generating means and said light generating means.

12. The alarm of claim 8, wherein said trigger means comprises delay means for delaying actuation of said alarm signal generating means for a preselected time interval subsequent to the arming of said alarm.

* * * * *